US005293155A

United States Patent [19]

Nicol et al.

[11] Patent Number: 5,293,155

[45] Date of Patent: Mar. 8, 1994

[54] INTERFACE FOR A SUPERVISED MULTI-INPUT AUDIBLE WARNING SYSTEM

[75] Inventors: John J. Nicol, North Brunswick; Bart Falzarano, Jr., Bayville; Joseph Kosich, South Toms River, all of N.J.

[73] Assignee: Wheelock Inc., Long Branch, N.J.

[21] Appl. No.: 681,758

[22] Filed: Apr. 10, 1991

Related U.S. Application Data

[63] Continuation-in-part of Ser. No. 520,269, May 7, 1990, abandoned.

[51] Int. Cl.[5] ..... G08B 29/00

[52] U.S. Cl. ..... 340/506; 340/511; 340/517; 340/519; 340/521; 340/692

[58] Field of Search ..... 340/506, 512, 513, 508, 340/511, 517, 692, 521, 519, 384 E

[56] References Cited

U.S. PATENT DOCUMENTS

| | | | |
|---|---|---|---|
| 3,430,231 | 2/1969 | Weld | 340/513 |
| 4,060,803 | 11/1977 | Ashworth, Jr. | 340/506 |
| 4,064,507 | 12/1977 | Schmitz | 340/692 |
| 4,401,971 | 8/1983 | Saito et al. | 340/692 |
| 4,438,422 | 3/1984 | Nojiri et al. | 340/692 |
| 4,785,280 | 1/1987 | Fubini et al. | 340/384 E |

FOREIGN PATENT DOCUMENTS

| | | |
|---|---|---|
| 1566699 | 4/1970 | Fed. Rep. of Germany . |
| 2508386 | 9/1975 | Fed. Rep. of Germany . |
| 2224898 | 1/1976 | Fed. Rep. of Germany . |
| 2756750 | 6/1979 | Fed. Rep. of Germany . |
| 2941262 | 4/1981 | Fed. Rep. of Germany . |
| 3525724 | 11/1987 | Fed. Rep. of Germany . |
| 8809503 | 12/1988 | Fed. Rep. of Germany . |

OTHER PUBLICATIONS

D. R. Pacholok, "Digital to Audio Decoder," *73 Magazine* Oct. 28, 1977.

C. Durst, "Scanning Adapter for FM Transceivers," *73 Magazine* Apr., 1973.

Adaptatone Multiple Tone Industrial Signal brochure, Jan. 1983.

*Primary Examiner*—Donnie L. Crosland

*Attorney, Agent, or Firm*—Brumbaugh, Graves, Donohue & Raymond

[57] ABSTRACT

An interface for a supervised multiple input, audible warning system is disclosed. The interface continuously monitors or supervises a plurality of circuits between a control unit and an alarm unit for electrical faults. Each circuit represents a separate alarming condition. All the circuits are coupled to but normally isolated from each other and a common circuit for driving a piezoelectric device. The isolation is accomplished by means of a semiconductor switch normally reverse biased. The semiconductor switch prevents the supervising current of one circuit from driving the piezo by isolating all possible flow paths to all circuits without current flow in the alarming direction. Upon sensing an alarming condition, the direction of the current in the alarming circuit reverses resulting in forward biasing the semiconductor switch. The current in the alarming circuit, no longer isolated from the common circuit, actuates the common circuitry necessary for generating the audible warning. The interface circuits may be connected to an addressable micro controller for selecting a multitude of sounds.

23 Claims, 4 Drawing Sheets

INTERFACE FOR A SUPERVISED MULTI-INPUT AUDIBLE WARNING SYSTEM

CROSS REFERENCE TO RELATED APPLICATION

This application is a continuation-in-part of copending application Ser. No. 520,269 filed May 7, 1990, now abandoned.

BACKGROUND OF THE INVENTION

This invention related to an interface for a supervised multi-input audible warning system.

Audible warning systems using piezoelectric devices for generating an alarm sound are well known. The piezo can be driven by a 555 timer configured as an oscillator. When an alarm condition is sensed, an input voltage is applied to the timer to drive the piezo. The vibration of the piezo generates the alarm sound.

The tone of the piezo is dictated by the frequency of the signal seen by the piezo, which is a function of the input voltage frequency to the timer. The frequency of the input voltage is controlled by the response characteristic of the passive elements comprising the network at the input of the timer. In essence, the tone of the piezo can be controlled by varying the equivalent capacitance seen by the input of the timer. This characteristic makes it possible to use one piezoelectric device to generate multiple tones merely by varying the capacitors used in the input circuitry. By placing multiple capacitors with different capacitances in parallel, the tone will vary depending on which of the capacitors has voltage applied across it. Furthermore, when the value of the capacitances vary significantly, if two or more capacitors have the same voltage applied across them, the capacitor with the higher or highest capacitance will drive the input frequency since that capacitor will substantially determine the equivalent capacitance seen by the input to the timer. This feature enables the differing alarm tones of one piezoelectric device to be prioritized.

By using a number of capacitors in parallel, one piezoelectric device can be used with more than one input thereby enabling a multitude of alarming conditions to be directed to a common circuit for generating the alarm sound. The ability of one piezo to generate a variety of tones depending on its input frequency (controllable by the capacitors chosen) permits one device to generate a different tone for each input. Such a design eliminates the number of piezoelectric devices needed for a given application.

Another desirable feature of an audible warning system is the ability to monitor or supervise the alarm-sensing and input circuitry for electrical faults. Without this feature an alarming condition may go unnoticed. The need for supervision is apparent considering that the bulk of the input circuit may be located in a control panel physically separated from the common circuitry located in an alarm unit. The distance between the control panel and the alarm unit increases the chances of an electrical fault in the wires connecting the two. Supervision alerts the system or an operator that one of the alarms may presently be disabled.

Supervising the circuitry typically consists of monitoring with a comparator a test current flowing through the input circuitry. Any fault in the circuit will be sensed by the comparator which will then alert the system and/or an operator of the problem. The test current often flows in the opposite direction of the input current to the timer. As a result, a diode placed between the input circuitry and the timer will prevent the test current from driving the timer.

Unfortunately, the two above-described desirable features, common circuitry from multiple inputs and supervised input circuitry, have been incompatible. In order for the two features to complement one another, the multiple input circuits must be isolated from each other. Without isolating either all current flow paths from the input circuitry to the common circuit or from the common circuit to the input circuitry, the supervising test current from one input could flow through the common circuitry and the input circuitry of another input resulting in an undesired actuation of the alarm. Therefore, the use of the diode, although adequate in single input warning systems, is inadequate in multiple input systems since it can only isolate one current path. Furthermore, without complete isolation of inputs, the disablement of one input could affect the operation of the other inputs by providing an unwanted current flow path.

Accordingly, it is an objective of the present invention to overcome the problems inherent in a supervised multi-input alarm utilizing common circuitry.

Another objective of the present invention is to combine the use of a supervised multi-input alarm with an addressable micro controller as part of the common circuit, thereby permitting selection from various programmed sounds depending on which of the supervised inputs is energized.

SUMMARY OF THE INVENTION

The present invention attains the foregoing and other objects by providing an interface bridging multiple input circuits in a control unit and a common circuit in an alarm unit while providing both supervision and isolation of each input circuit. The interface comprises a set of interface circuits that selectively transmit a signal from a power source to the common circuit. Each interface circuit is coupled to the power source. A device such as a comparator is coupled to the power source for supervising the interface circuit for electrical faults. A switch or similar device having an input coupled to the power source is capable of reversing the current flow through the output of the switch either from an alarming direction to a supervising direction or from a supervising direction to an alarming direction. Coupled to the output of the switch are isolation components that allow current in the alarming direction to flow into the common circuit. However, the isolation components block supervising current from flowing into the common circuit. A resistor or similar component is coupled to the switch output for providing a current flow path in the interface circuit when current is flowing in the supervising direction.

Each interface circuit providing an input to the common circuit is supervised for electrical faults regardless of the current flow direction yet is isolated from the common circuit when current does not flow in the alarming direction. The complete isolation of any path to any interface circuit while the current flows in the supervising direction prevents any supervising current from driving the piezo or from causing false supervision trouble signals. Alternatively, the complete isolation of any supervising current path from the interface circuit to the common circuit or other interface circuit will likewise prevent the supervising current from driving the piezo or from causing false supervision trouble signals.

Additionally, the interface circuits may be connected to an addressable decoder such as a micro controller for selecting a multitude of sounds through inputs. The micro controller decodes the input from the interface circuits and generates an electrical signal of at least one frequency corresponding to the input. The micro controller also internally prioritizes the various input signals to determine which predetermined audible output should prevail if more than one input signal is energized at one time. The addressable decode, alternatively, can be a logic array.

BRIEF DESCRIPTION OF THE DRAWINGS

The above and further advantages of the invention will be better understood with respect to the following detailed description of a preferred embodiment, taken in combination with the several figures of the associated drawings in which.

DESCRIPTION OF THE PREFERRED EMBODIMENTS

Figure 1:
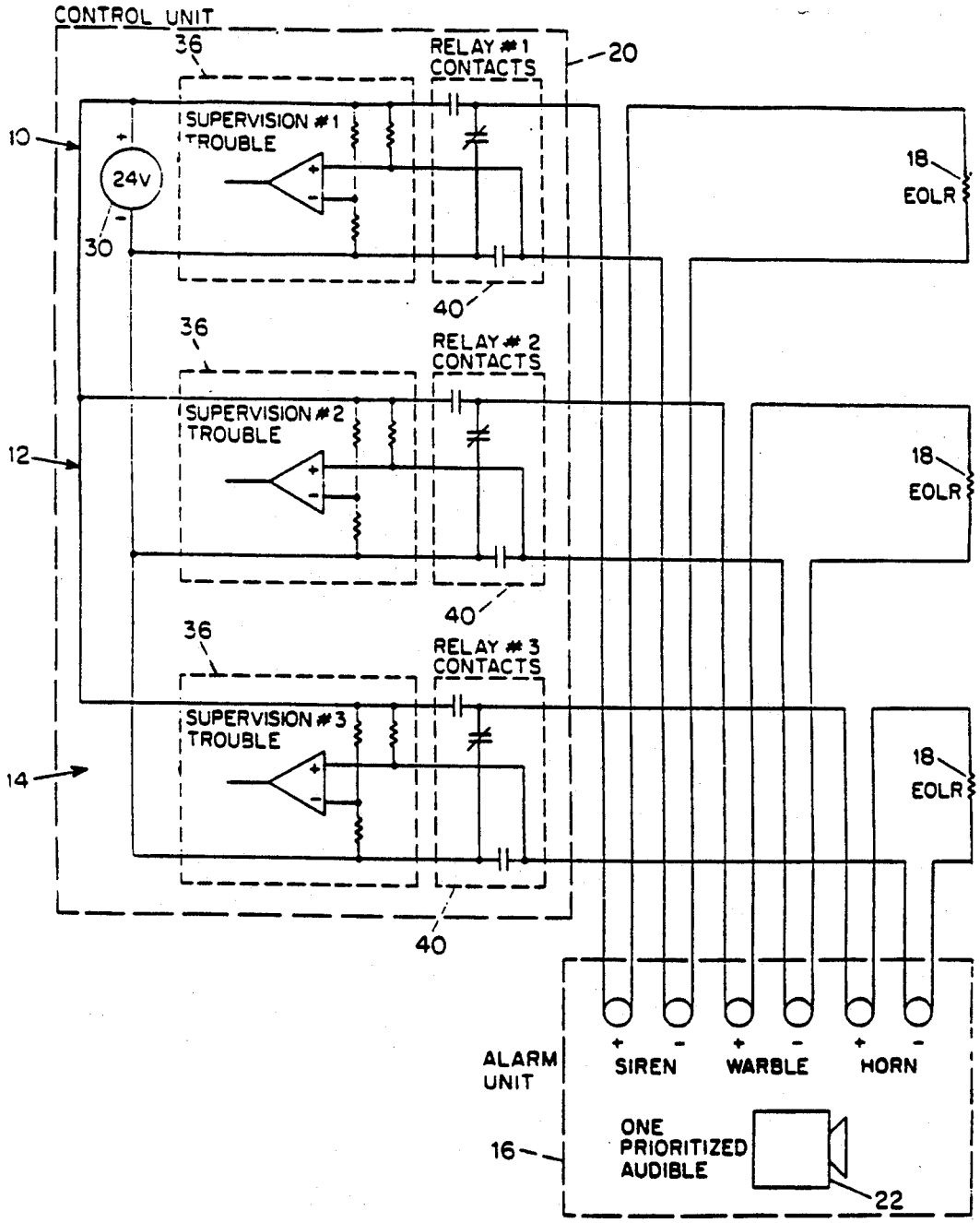
FIG. 1 is a circuit diagram illustrating the interrelation between the control unit and the alarm unit in the supervising mode.
Figure 2:
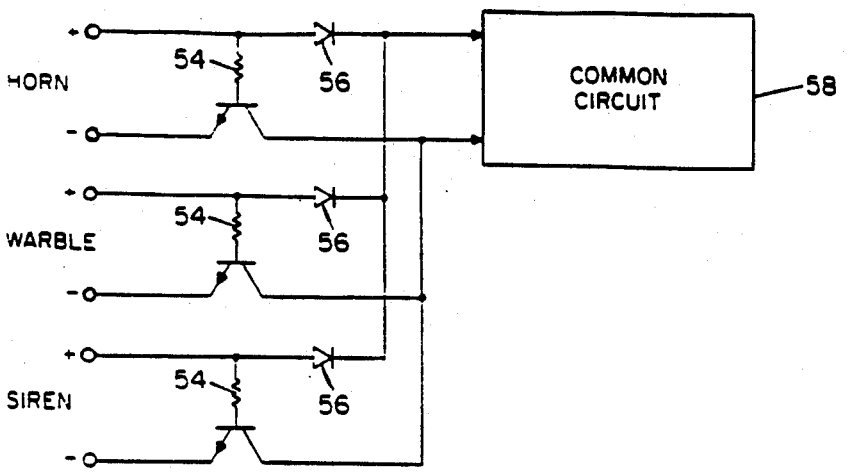
FIG. 2 is a circuit diagram of the isolating components.
Figure 3:
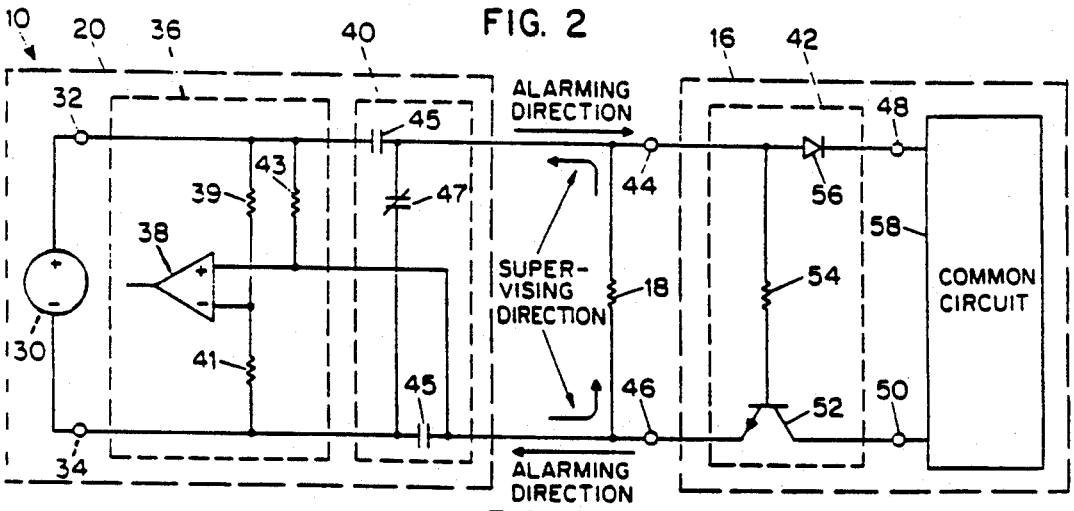
FIG. 3 is a circuit diagram of an interface circuit.

A preferred embodiment of the invention is shown in FIGS. 1-3. FIG. 1 shows the control unit portions of three interface circuits 10, 12 and 14 and how they are connected separately to an alarm unit 16. In this preferred embodiment, the three interface circuits 10, 12 and 14 are powered from a common 24 volt DC power source 30. Other voltage levels, such as a 12 volt DC supply could be used. An end of line resistor 18 in each interface circuit 10, 12 and 14 is physically located outside both a control unit 20 and the alarm unit 16. The interface circuits 10, 12 and 14 are individually coupled to separate terminals at the alarm unit 16 so that each interface circuit 10, 12, 14 corresponds to a different tone (siren, warble or horn) generated by a piezo 22. If desired, the inputs from circuits 10, 12, and 14 can be connected to the alarm unit 16 for unsupervised use through either a common positive terminal or a common negative terminal.

FIG. 2 illustrates how the portion of the three interface circuits 10, 12 and 14 within the alarm unit 16 are coupled to a common circuit 58. In view of this arrangement and the common power source 30 to the three interface circuits 10, 12 and 14, the three interface circuits are in parallel. In actuality, one of the prioritizing capacitors is in series with a corresponding interface circuit 10, 12 or 14. The circuitry between the three capacitors and the piezo 22 is the common circuitry.

The alarm may comprise an audible unit only, or it may comprise a continued audible/visual unit. In the latter case, a visual alarm circuit, such as a strobe circuit, is coupled in parallel to the common circuit 58 with separate inputs from the interface circuits 10, 12, and 14.

FIG. 3 is a circuit diagram of one of the interface circuits, e.g. circuit 10, coupled to the power source 30 and the alarm unit 16, the other two circuits 12 and 14 being coupled thereto in an identical manner. The power source, physically within the control unit 20, is coupled to the interface circuit 10 at terminals 32 and 34 but could also be integral to the interface circuit 10. A supervising circuit 36, also within the control unit 20, is in parallel with the power source 30. The supervising circuit 36 has an operational amplifier 38 configured as a comparator and connected across the power source 30 by resistors 39, 41, 43. The supervising circuit 36 monitors the current flowing through the interface circuit 10. An electrical fault in the interface circuit 10, such as a disconnected wire, will be sensed by the supervising circuit 36, which will then provide an indication that the interface circuit 10, and therefore an alarm, may not be functioning properly.

Also within the control unit 20 and connected to the power source 30 and the supervising circuit 36 is a switching device 40 that can reverse the direction of current flow at its output. This is accomplished by a network of normally open and normally closed relay contacts 45 and 47, respectively, that upon shifting change the direction of the current at the output of the interface circuit 10. The two current directions will be referred to as the supervising direction and the alarming direction and are indicated by arrows in FIG. 3. Normally, i.e., in the absence of an alarming condition, the current flows in the supervising direction. A signal resulting from the sensing of an alarming condition transfers the relays 45 and 47 causing the current to flow in the alarming direction. The sensing circuit, which is conventional, is not shown.

The end of line resistor 18 is connected in parallel with the output of the switching device 40. As long as the current in the interface circuit 10 is flowing in the supervising direction, the end of line resistor 18 completes the current path. However, the large resistance of the end of line resistor 18 relative to the resistance of the common circuit 58 minimizes the current through it when the current flows in the alarming direction.

In parallel with the end of line resistor 18 and the output of the switching device 40 are the isolation components 42 of the interface circuit 10. These components are physically within the alarm unit 16. The upper input terminal 44 to the isolation components is a positive terminal when the current flows in the alarming direction and a negative terminal when the current flows in the supervising direction. The opposite is true of the lower input terminal 46. Upper and lower output terminals 48, 50 couple the isolation components 42 to the common circuit 58 that drives the piezo 22 (not shown in FIG. 3).

In this preferred embodiment, the central isolation component is a bipolar NPN transistor 52. A resistor 54 connects the base of transistor 52 to the upper input terminal 44. A blocking diode 56 coupled between the upper input terminal 44 and upper output terminal 48 prevents current flow from the common circuit or other interface circuits 10, 12 and 14 through the upper output terminal 48. The diode 56 also prevents current from the common circuit 58 or from other interface circuits from forward biasing the transistor 52. The transistor collector is connected to the lower output terminal 50.

The transistor emitter is connected to the lower input terminal 46.

Normally, i.e., in the absence of an alarming condition, the current flows through the interface circuit 10 in the supervising direction as indicated by the arrows in FIG. 3. This current flow reverse biases the transistor 52 thereby isolating the interface circuit 10 from the common circuit 58. The combination of the diode 56 and the reverse biased transistor 52 ensures that no current path from another interface circuit or the common circuit 58 exists. However, a complete current path still exists from the power source 30 through the switching device 40 and the end of line resistor 18. This permits the interface circuit 10 to be continually monitored for electrical faults.

Upon transfer of the contact relays 45, 47 in the switching device 40 (due to the presence of an alarming condition), current at the output of the switching device 40 will reverse to the alarming direction. The transistor 52 is now forward biased allowing current to flow between the interface circuit 10 and the common circuit 58. The combination of the blocking diodes 56 and the reverse biased transistors 52 of the non-alarming interface circuits 12 and 14 maintain their isolation from the alarming interface circuit 10 and the common circuit 58. If two or more interface circuits have current flowing in the alarming direction, the interface circuit with the biggest prioritizing capacitor will dictate the tone of the piezo 22.

Figure 4:
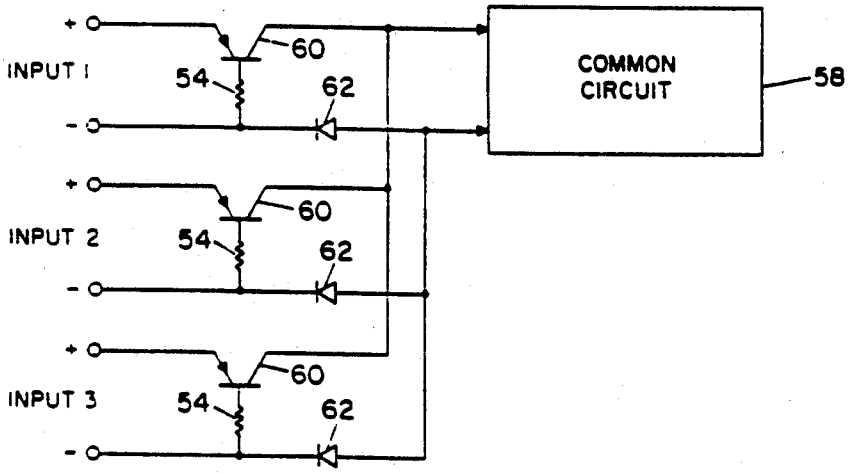
FIG. 4 is a circuit diagram of an alternate arrangement of the isolating components.

FIG. 4 illustrates an alternate arrangement of the isolation components 42 utilizing a PNP transistor 60. The basic operation of the circuit is identical except that the transistor 60 isolates the upper inputs to the common circuit 58 while the diode 62 isolates the lower inputs to the common circuit.

Figure 5:
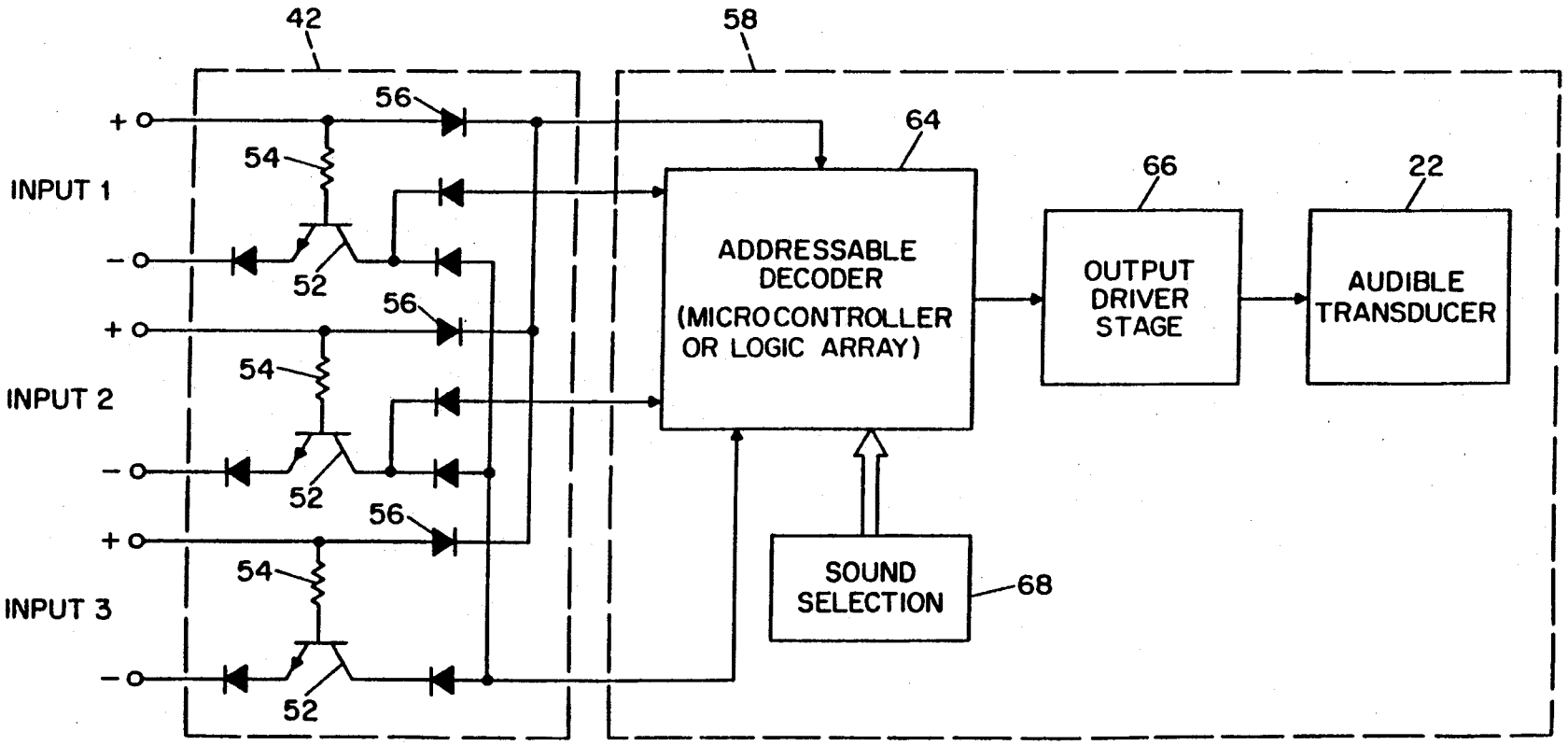
FIG. 5 is a block diagram of the supervised multi-input audible warning system.

Another preferred embodiment of the invention is shown in FIG. 5. In this embodiment, the interface circuits are coupled to an addressable decoder such as a micro controller 64 or an ASIC custom chip which is part of the common circuit 58. The micro controller 64 is a COP four bit micro controller driven by software written for use with this micro controller and copied into internal ROM memory.

Each interface circuit connected to the micro controller 64 provides one bit of input, i.e., whether or not the interface circuit is operating in the alarming direction. The software program in the micro controller 64 decodes the input information from the interface circuits through a series of algorithms and, after decoding, generates the frequency or frequencies which create the sound or sounds that correspond to the input. The software program uses several internal registers and ports of the micro controller 64 to perform the decoding and sound generating functions. Decoding of the addressable interface circuit outputs is provided by reading the data present on an eight bit input port of the micro controller 64. After the software program has decoded the input, it then, based on the input, selects a corresponding program number. The program number contains a program which will generate the sound signal corresponding to the unique input. The frequency signal that is generated is then sent to an output driver stage 66 where it is played audibly through a piezo electric transducer 22, thus producing the selected sound.

The software program that drives the micro controller 64 has the ability to decode the addressable inputs of the interface circuits 10, 12 and 14 as described above and sound selection inputs such as from jumpers or a dip switch 68. Selection of a group of sounds is provided through the dip switch 68.

Each group contains different combinations of the same or different sounds. With three interface circuits 10, 12, 14, each group has three sounds, one corresponding to each interface circuit. The groups are selectable from a dip switch 68 coupled to the micro controller 64. The position of the dip switch 68 dictates the sound generated from the alarm condition indicated by the interface circuit 10, 12 or 14.

Each interface circuit 10, 12, 14 is assigned a priority in the software program. When an interface circuit 10, 12 or 14 has current flowing in the alarming direction, i.e., transmitting an input to the micro controller 64, the micro controller decodes the priority of the interface circuit. In this embodiment there are three interface circuits 10, 12, 14. Two of the three interface circuits have terminal inputs to the micro controller 64, each with a certain priority level. The third interface circuit supplies power to the common circuit 58, in effect having the lowest priority level. One interface circuit 10 is programmed to be read as a top or first priority. When the top priority interface circuit 10 becomes energized, the audible corresponding to top priority will remain energized regardless of the other priorities. The only time the top priority is interrupted is when the top priority is deenergized. The second interface circuit 12 is programmed to be read as the second priority. When a second priority interface circuit 12 is energized, the micro controller first makes sure the top priority interface circuit 10 is not energized. If the top priority is not energized, the second priority is accepted by the micro controller 64. The third priority results when neither the first nor the second interface circuit is energized. Then and only then will the micro controller 64 accept the third priority. As a result of using the micro controller 64 to prioritize the inputs, no external circuit elements are necessary to accomplish prioritization.

Figure 6:
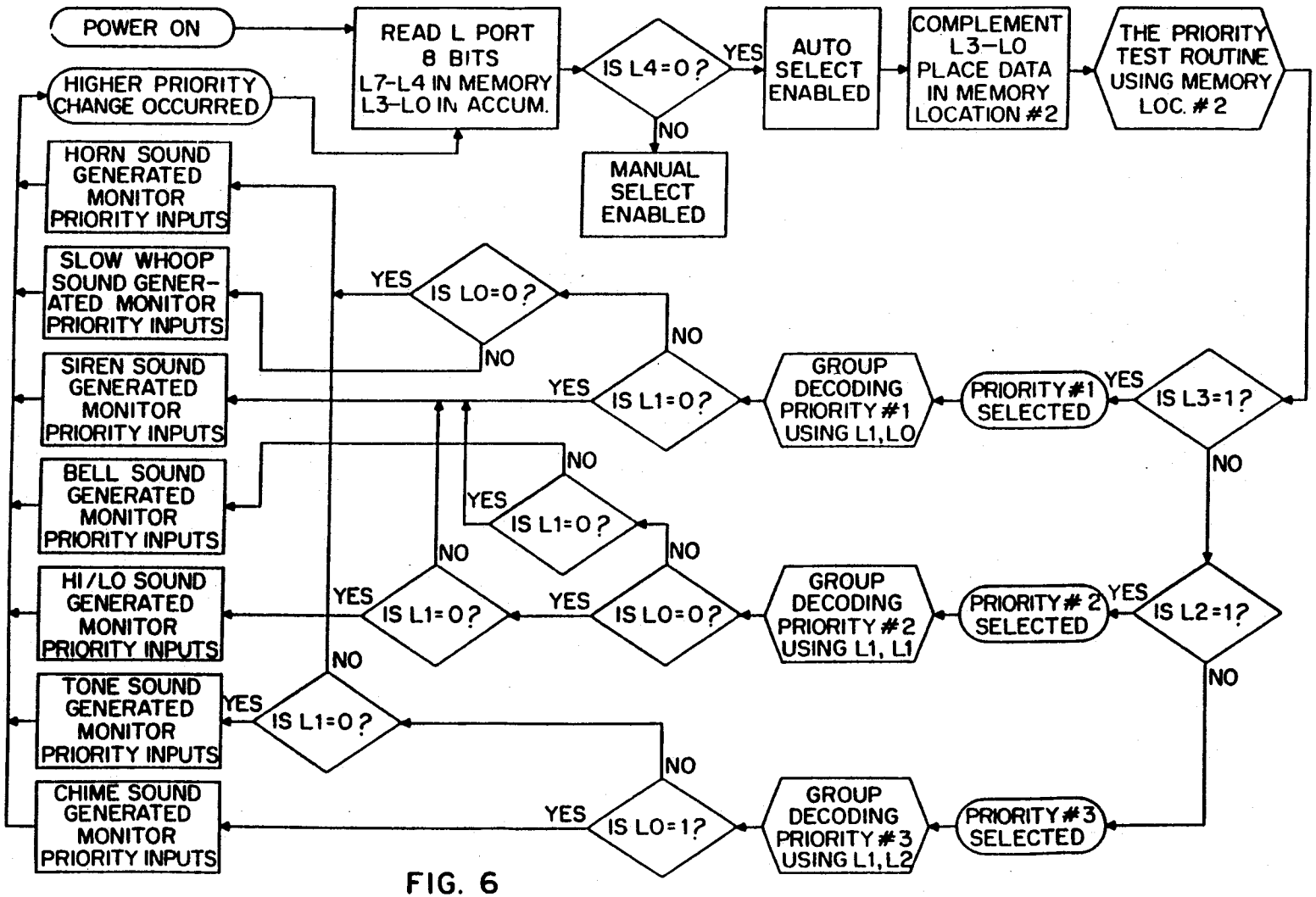
FIG. 6 is a flow chart of the micro controller addressable selection function.

The software program that runs the micro controller 64 is designed to accept immediate priority changes at any time. For example, the warning system may be used to warn workers of potential and actual hazardous situations. The top priority would be assigned to the actual hazardous condition while the second priority would be assigned to the potential hazardous condition. While the potential condition exists and the warning system alarms accordingly, if the actual condition is sensed, the warning system via the internal prioritization of the interface circuits within the micro controller will transfer from the potential hazardous condition warning sound to the actual hazardous condition warning sound. A flow chart of this function is shown at FIG. 6.

The output signal from the micro controller 64 is processed in the output driver stage 66, typically including a power transistor or audio amplifier and a step up transformer. The output driver stage 66 then drives the audible piezo electric transducer 22.

Although the invention has been illustrated and described herein by reference to a specific embodiment thereof, it will be understood by those skilled in the art that such embodiment is susceptible to modification and variation without departing from the inventive concepts disclosed. All such modification and variations, therefore, are intended to be encompassed within the spirit and scope of the appended claims.

We claim:

1. An interface for selectively transmitting via a plurality of interface circuits a plurality of signals from a power source to a common circuit, said common circuit being used for driving an alarm, each interface circuit comprising:

means for coupling the interface circuit to a power source between a positive node and a negative node of said coupling means;

supervising means electrically connected in parallel across the coupling means between said positive and negative nodes for supervising the interface circuit for electrical faults;

switching means, having an input through which current flows, electrically connected in parallel across the coupling means between said positive and negative nodes, and an output, said output having a first output node and a second output node, for reversing said current flow through the output between an alarming direction flowing from said first output node and a supervising direction flowing from said second output node;

isolation means, having an input coupled in parallel with the switching means output between said first and second output nodes, and having an output for coupling with the common circuit, for allowing current in the alarming direction flowing from said first output node to flow into the common circuit and for blocking current flow between the interface circuit and the common circuit when current is flowing in the supervising direction from said second output node; and resistor means connected in parallel with the switching means output for providing a supervising current flow path in the interface circuit when current is flowing in the supervising direction;

whereby the interface circuit is supervised for electrical faults regardless of current flow direction yet isolated from the common circuit and the other interface circuits when the current is not flowing in the alarming direction.

2. An interface according to claim 1, wherein the isolation means blocks the current flow path from the common circuit to the interface circuit when current is not flowing in the alarming direction.

3. An interface according to claim 2, wherein the isolation means comprises a diode coupled between a first output terminal of the switching means and a first input terminal of the common circuit for blocking current from the common circuit to the interface circuit, and an NPN bipolar transistor having its base coupled to the first output terminal of the switching means, its emitter coupled to a second terminal of the switching means and its collector coupled to a second input terminal of the common circuit such that the bipolar transistor is forward biased when current flows in the alarming direction but is reversed biased when current flows in the supervising direction.

4. An interface according to claim 1, wherein the isolation means blocks the current flow path from the interface circuit to the common circuit when current is not flowing in the alarming direction.

5. An interface according to claim 4, wherein the isolation means comprises a PNP bipolar transistor having its emitter coupled to a first output terminal of the switching means, its collector coupled to a first input terminal to the common circuit and its base coupled to a second output terminal of the switching means such that the transistor is forward biased when current flows in the alarming direction but is reverse biased when the current flows in the supervising direction, and a diode coupled between the second output terminal of the switching device and a second input terminal of the common circuit for blocking current from the interface circuit to the common circuit.

6. An interface according to claim 1, wherein the alarm comprises a piezoelectric device.

7. A supervised multi-input audible warning system for generating an audible alarm from at least one of multiple input circuits, comprising:

addressable decoding means for decoding an input and generating an electrical signal of at least one frequency corresponding to the input;

audible alarming means for transforming the electrical signal into an audible output corresponding to the frequency of the electrical signal; and an interface for selectively transmitting via a plurality of interface circuits the input to the addressable decoding means, each interface circuit including:

means for coupling the interface circuit to a power source between a positive node and negative node of said coupling means;

supervising means electrically connected across the coupling means between said positive and negative nodes for supervising the interface circuit for electrical faults;

switching means, having an input through which current flows, electrically connected across the coupling means between said positive and negative nodes and an output, said output having a first output node and a second output node, for reversing current flow through the output between an alarming direction flowing from said first output node and a supervising direction flowing from said second output node;

isolation means, having an input coupled in parallel with the switching means output between said first and second output nodes and having an output for coupling with the addressable decoding means, for allowing current in the alarming direction flowing from said first output node to flow into the addressable decoding means as the input and for blocking current flow between the interface circuit and the addressable decoding means when current is flowing in the supervising direction flowing from said second output node; and resistor means connected in parallel with the switching means output for providing a supervising current flow path through the interface circuit when current is flowing in the supervising direction;

whereby the interface circuit is supervised for electrical faults regardless of current flow direction yet is isolated from the addressable decoding means and the other interface circuits when the current is not flowing in the alarming direction.

8. A supervised multi-input audible warning system according to claim 7, wherein said addressable decoding means internally prioritizes the frequency of said electrical output from among said inputs so that each of said interface circuits has a different predetermined priority in overriding the other interface circuits when more than one of said interface circuits has current flowing in the alarming direction.

9. A supervised multi-input audible warning system according to claim 7, further comprising:

manual selection means coupled to said addressable decoding means for manually selecting said audible alarm.

10. A supervised multi-input audible warning system according to claim 9, wherein said manual selection means is a dip switch.

11. A supervised multi-input audible warning system according to claim 7 further comprising group selection means coupled to said addressable decoding means for selecting among a plurality of electrical signal frequency outputs corresponding to one of said inputs.

12. A supervised multi-input audible warning system according to claim 11, wherein said group selection means is a dip switch.

13. A supervised multi-input audible warning system according to claim 7 wherein said addressable decoding means is a micro controller.

14. A supervised multi-input audible warning system according to claim 7 wherein said addressable decoding means is a logic array.

15. A supervised multi-input audible warning system according to claim 7 wherein said addressable decoding means is an ASIC.

16. A multi-input audible warning system for generating an audible alarm from at least one of a plurality of multiple input circuits, comprising:

multiple input means for providing a plurality of potential input signals for generating an audible alarm;

addressable decoding means coupled to said multiple input means for prioritizing said potential input signals from a highest priority to a lowest priority;

audible alarming means for generating in response to the highest priority of said potential input signals an audible frequency-response output corresponding to said highest priority input signal, said audible alarming means including means for generating a plurality of audible signal frequency outputs; and selection means coupled to said addressable deocoding means for selecting said audible frequency-response output from among said plurality of audible signal frequency outputs corresponding to one of said input signals.

17. A multi-input audible warning system for generating an audible alarm according to claim 16 wherein said addressable decoding means further comprises transfer means for shifting from an output corresponding to a lower priority input signal already energized to an output corresponding to a higher priority signal subsequently energized.

18. A multi-input audible warning system for generating an audible alarm according to claim 17 wherein said transfer means automatically shifts from said lower priority output to said higher priority output.

19. A multi-input audible warning system for generating an audible alarm according to claim 16 wherein said multiple input means comprises three input terminals.

20. A multi-input audible warning system for generating an audible alarm according to claim 16 wherein said addressable decoding means is a micro controller.

21. A multi-input audible warning system for generating an audible alarm according to claim 16 wherein said addressable decoding means is a logic array.

22. A multi-input audible warning system for generating an audible alarm according to claim 16 wherein said addressable decoding means is an ASIC.

23. A multi-input audible warning system according to claim 16, wherein said group selection means is a dip switch.

* * * * *